US007845078B2

(12) United States Patent
Shimizu

(10) Patent No.: US 7,845,078 B2
(45) Date of Patent: Dec. 7, 2010

(54) ROTARY ELECTRIC SHAVER

(75) Inventor: Tetsuhiko Shimizu, Matsumoto (JP)

(73) Assignee: Izumi Products Company, Nagano (JP)

( * ) Notice: Subject to any disclaimer, the term of this patent is extended or adjusted under 35 U.S.C. 154(b) by 319 days.

(21) Appl. No.: 11/975,000

(22) Filed: Oct. 17, 2007

(65) Prior Publication Data

US 2008/0092392 A1 Apr. 24, 2008

(30) Foreign Application Priority Data

Oct. 18, 2006 (JP) ..... 2006-283389

(51) Int. Cl.
*B26B 19/14* (2006.01)

(52) U.S. Cl. ..... 30/43.5; 30/43.4

(58) Field of Classification Search ..... 30/43.5, 30/43.4, 42, 346.51, 43.6
See application file for complete search history.

(56) References Cited

U.S. PATENT DOCUMENTS 2,536,015 A * 12/1950 Konrad ..... 30/43.6
2,952,908 A * 9/1960 Jozephus et al. ..... 30/43.5
3,636,626 A 1/1972 Zuurveen
3,656,235 A * 4/1972 Zuurveen ..... 30/346.51
5,983,501 A * 11/1999 Izumi ..... 30/43.5
6,460,252 B1 * 10/2002 Nakano ..... 30/43.4
6,901,662 B1 * 6/2005 Steinberg ..... 30/43.3

FOREIGN PATENT DOCUMENTS

| | | |
|---|---|---|
| EP | 0 544 065 | 6/1993 |
| EP | 1 063 066 | 12/2000 |
| JP | 55-158084 | 12/1980 |
| JP | 2001-000755 | 1/2001 |

* cited by examiner

*Primary Examiner*—Boyer D Ashley
*Assistant Examiner*—Omar Flores-Sánchez
(74) *Attorney, Agent, or Firm*—William L. Androlia; H. Henry Koda

(57) ABSTRACT

A rotary electric shaver including an outside outer cutter and an inside outer cutter capable of mutually moving up and down independently, a drive shaft to which an upward return tendency is imparted, an outside inner cutter guide that engages the drive shaft and rotates integrally therewith, an outside inner cutter secured to the outside inner cutter guide, an inside inner cutter guide having a plurality of engagement pawls that engage the outside inner cutter guide from above so as to be able to move up and down and that rotates together with the outside inner cutter guide, an inside inner cutter secured to this inside inner cutter guide, and an upward-pushing spring mounted between the upper surface of the outside inner cutter guide and the lower surface of the inside inner cutter guide, for urging the inside inner cutter guide upward.

4 Claims, 4 Drawing Sheets

ROTARY ELECTRIC SHAVER

BACKGROUND OF THE INVENTION

1. Field of the Invention

The present invention relates to a rotary electric shaver wherein an inner cutter rotates while, from below, sliding against a plurality of outer cutters provided coaxially.

2. Description of the Related Art

For some time, rotary electric shavers of the so-called two-track (double track) type, having two tracks (ring-shaped channels wherein the inner cutter travels) provided coaxially in a ring-shaped outer cutter, have been widely used. Here, the two tracks are provided in one common outer cutter, and the two inner circumferential and outer circumferential tracks are corresponding. The inner cutter that slides against these two tracks is also formed integrally. That is, the inner cutter is such that an outside inner cutter that slides against the outer circumferential track and an inside inner cutter that slides against the inner circumferential track are made integral therein, this inner cutter is made to engage from above with a drive shaft that is urged upward, and the inner cutter presses against the outer cutter due to the upward return force on the drive shaft.

With this conventional shaver, there is a problem that because the outer cutter is made integral, the entire surface contacting the skin will move up and down in correspondence with irregularities in the skin surface, but the outer cutter cannot minutely follow the fine irregularities in the skin surface.

Thereupon, in Japanese Patent Application Laid-Open Nos. 2001-755 and 55-158084, for example, it is proposed that the outer cutter be divided so as to correspond to inner and outer circumferential tracks, making an inside outer cutter and an outside outer cutter capable of independently moving up and down.

In the shavers disclosed in Japanese Patent Application Laid-Open Nos. 2001-755 and 55-158084, the outer cutter is divided between the inner and the outer circumference, but the inner cutter support structure is very complex, the number of parts is extremely large, and the shavers become large and bulky. In the shavers described in Japanese Patent Application Laid-Open Nos. 2001-755 and 55-158084, holder units for the outside inner cutter and the inside inner cutter are formed in tubular shapes on the same axis, and these tubular holder units are driven by a motor. Furthermore, springs for urging the respective tubular holder units upward are accommodated inside these tubular holder units. As a consequence, the size becomes larger, with the up-and-down dimension and the diameter of the support portion of the inner cutter becoming large. Furthermore, because the structure is complex, there are other problems, such as the assembly is difficult and the number of assembly operations is increased, it is very difficult to effect a water-resistant structure, and cleaning out whisker shavings is also difficult.

Moreover, because the structure of the drive system for transmitting the rotation of the motor to the inner cutter differs drastically from the conventional structure wherein an upward return force is imparted to the drive shaft, a dedicated design becomes necessary, and it becomes necessary also to introduce new manufacturing equipment.

SUMMARY OF THE INVENTION

Accordingly, an object of the present invention, which was devised in view of such circumstances as describes above, is to provide a rotary electric shaver where the inner cutter support structure is simplified, making it possible to reduce the number of parts and make the shaver size smaller, assembly is easy and productivity can be improved, the adoption of a water-resistance structure becomes easy, cleaning whisker shavings is made easy, and introducing new manufacturing equipment can be made unnecessary.

The above object is accomplished by a unique structure of the present invention for a rotary electric shaver including a plurality of outer cutters mutually provided coaxially and a plurality of inner cutters that rotate while sliding against these outer cutters from below. The electric shaver further includes an outside outer cutter and an inside outer cutter capable of moving up and down, independently of each other, while being concentric and coaxial, a drive shaft that is rotationally driven by an electric motor and to which an upward return tendency is imparted (an upwardly biasing force), an outside inner cutter guide that engages with this drive shaft and rotates integrally with this drive shaft; an outside inner cutter that is secured to this outside inner cutter guide and slides against the outside outer cutter from below, an inside inner cutter guide that has a plurality of engagement pawls for engaging the outside inner cutter guide from above so as to be able to move up and down and that rotates together with the outside inner cutter guide, an inside inner cutter that is secured to this inside inner cutter guide and slides against the inside outer cutter from below, and an upward-pushing spring that is loaded between the upper surface of the outside inner cutter guide and the lower surface of the inside inner cutter guide, for urging the inside inner cutter guide upward.

In other words, the inner- and outside inner cutter guides are mutually displaced in the axial direction, making them multi-level, and an upward-pushing spring is sandwiched between the two.

While dividing the outer cutter between an inside outer cutter and an outside outer cutter, and making them capable of moving up and down independently, respectively, the inner cutter that slides against these inner- and outside outer cutters from below is divided between an inside inner cutter and an outside inner cutter, which are made, respectively, so as to slide independently against the inner- and outside outer cutters. With this construction the ability to follow the skin surface is enhanced and it is possible to improve both the quality of the shave and the feel of the shave.

To the drive shaft to which an upward return tendency is imparted, an outside inner cutter guide to which the outside inner cutter is secured is engaged, so the outside inner cutter is pressed against the outside outer cutter by the return force on the drive shaft. As a consequence, there is no need for a dedicated spring for upwardly urging the outside inner cutter.

Furthermore, the inside inner cutter guide to which the inside inner cutter is secured engages the outside inner cutter guide from above so that it can move up and down, and an upward return force is imparted to the inside inner cutter by a spring that is compressed between these two inner cutter guides. The outside inner cutter guide and the inside inner cutter guide, therefore, will be held so as to be mutually superimposed in the axial direction in what might be called an up-and-down bi-level configuration. As a consequence, there is no need to form the two inner cutter guides concentrically, nor is there any need to load a spring inside this concentric tube. Hence the number of parts is reduced, the structure is simplified, and making the shaver smaller is possible.

Furthermore, because the structure is simple, assembly is also easy, and productivity improves. Moreover, adopting a water-resistant structure is also easy, and cleaning the whisker cuttings also becomes easy. Meanwhile, the drive shaft to which the upward return tendency is imparted is of a structure widely adopted in conventional electric shavers. Therefore, since all that need be done is to modify the inner cutter support structure, conventional production equipment may be easily used, and the need to introduce special new manufacturing equipment is eliminated.

In the present invention, the outside inner cutter guide can be made one comprised of a tubular unit having an engagement hole into which the drive shaft engages, an outside inner cutter holder unit that extends from the upper part of this tubular unit in the outer circumferential direction, and a plurality of openings that pass through that outside inner cutter holder unit in the up and down direction. In this case, the inside inner cutter guide can be structured so as to comprise an inside inner cutter holder unit positioned above the outside inner cutter guide, and a plurality of engagement pawls, that extend downward from this inside inner cutter holder unit, advance into the outside inner cutter guide openings, and engage the outside inner cutter guide so as to be able to move up and down.

Still further the outer cutter can be made so that, causing the outer circumference of the inside outer cutter to engage the inner circumferential edge of the outside outer cutter, it is made to be capable of mutual independent up-and-down movement (sinking in). If this is done, then the outside outer cutter and the inside outer cutter can be brought into close proximity, and the gap in the radial direction there between can be made small.

In order to cause the outer circumference of the inside outer cutter to engage with the inner circumference of the outside outer cutter, all that need be done is to form slits that open downward, at a plurality of places in the circumferential direction, in the inner circumference of the outside outer cutter, cause pawls for engaging these slits in the outer circumference of the inside outer cutter to protrude in the outer radial direction; and, when these slits and pawls are engaged, to secure the inner circumferential lower edge of the outside outer cutter in the circumferential direction with an anti-vibration ring. The slits and the pawls may also be reversed. That is, it is also possible to provide pawls which protrude out in the inner radial direction of the outside outer cutter, and provide slits in the inner circumference of the inside outer cutter.

If a protruding wall erected in the outside inner cutter guide so as to be oriented upward is made to slide against the inner circumference of this anti-vibration ring, shaft wobble in the outside inner cutter guide can be prevented.

DETAILED DESCRIPTION OF THE INVENTION

Figure 1:
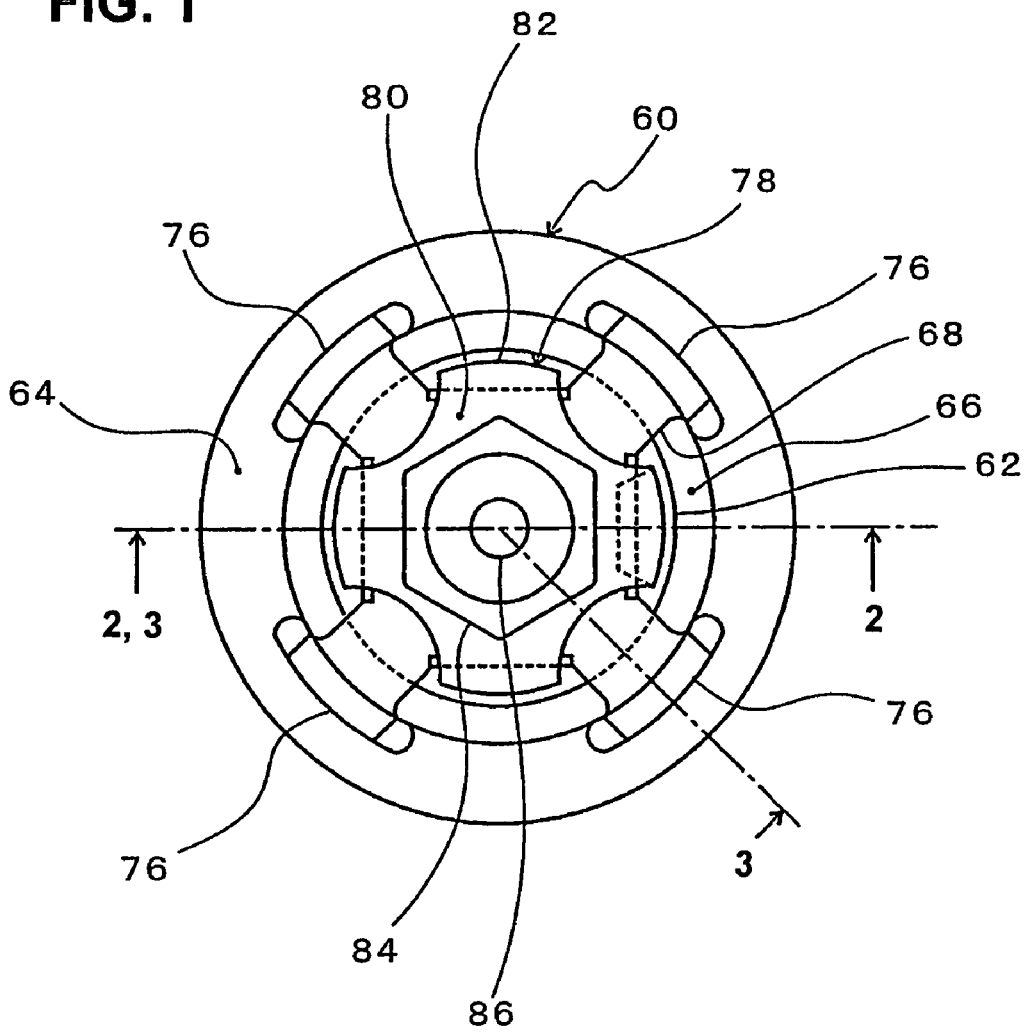
FIG. 1 is a top plan view of an assembled inner cutter support unit according to one embodiment of the present invention with the outer cutter and inner cutter excluded.
Figure 2:
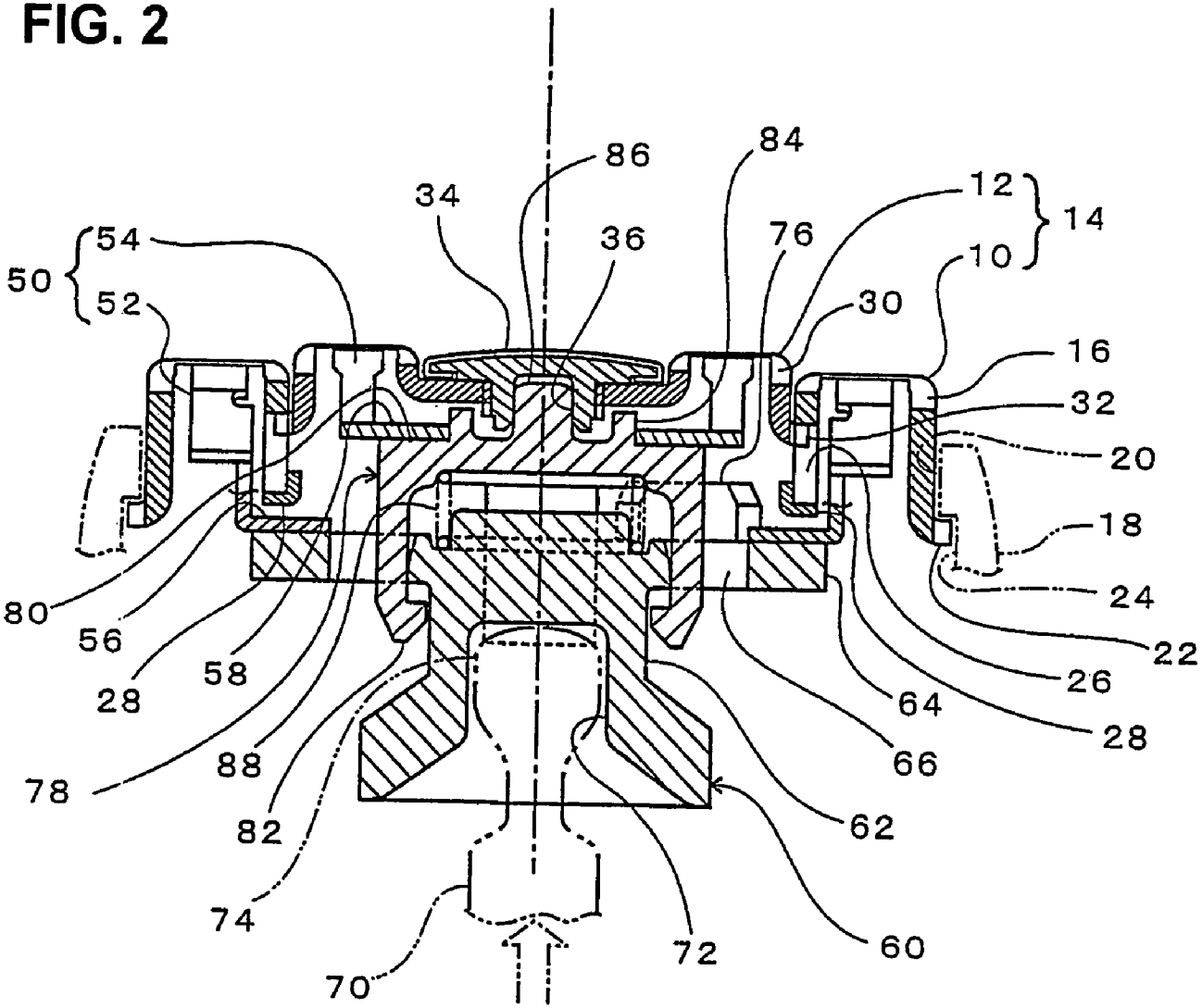
FIG. 2 is a cross-section taken along the lines 2-2 in FIG. 1, showing the outer cutter and inner cutter in their combined.
Figure 3:
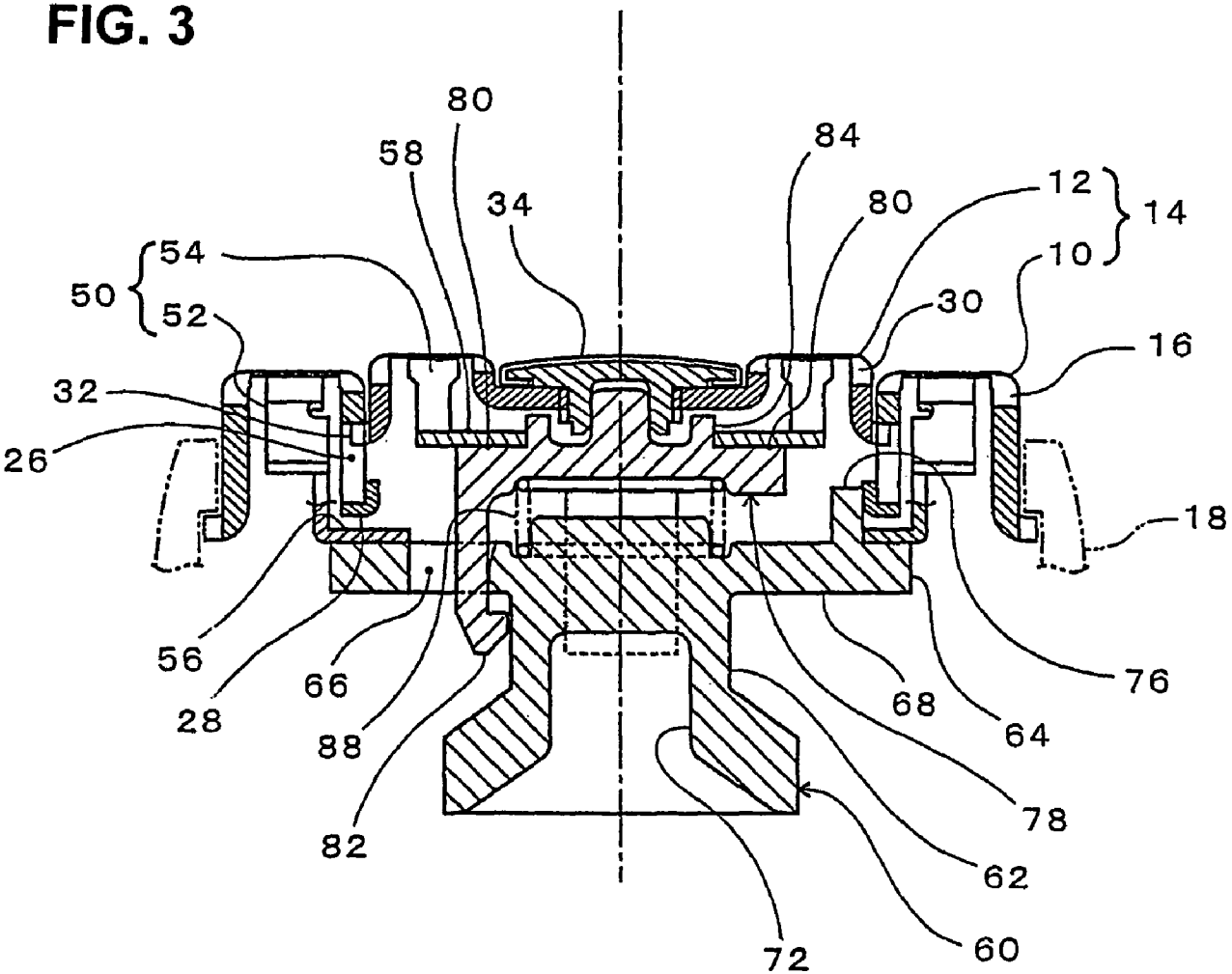
FIG. 3, similarly, is a cross-section taken along the lines 3-3 in FIG. 1.
Figure 4:
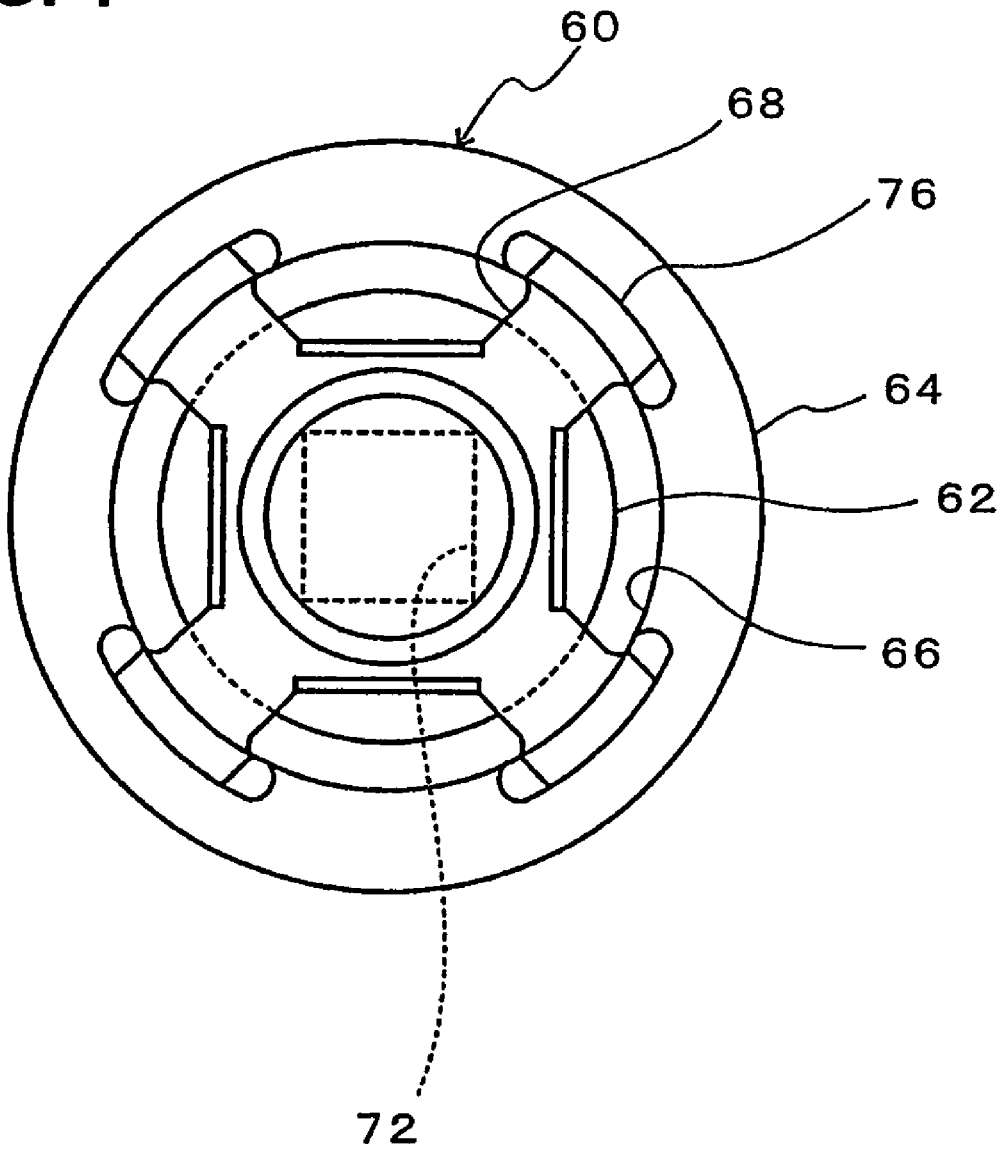
FIG. 4 is a top plan view of an outside inner cutter guide in the present invention.

FIG. 1 is a top plan view diagramming the assembled condition of an inner cutter support unit that is one embodiment of the present invention, FIG. 2 is a section view taken along the lines 2-2 in FIG. 1, diagramming the outer cutters and inner cutters in their combined condition, FIG. 3, similarly, is a section view taken along the line 3-3 in FIG. 1, and FIG. 4 is a top plan view of an outside inner cutter guide. FIGS. 1 and 4, moreover, diagram conditions with the outer cutter(s) and inner cutter(s) excluded.

In FIGS. 2 and 3, symbol 10 designates an outside outer cutter, and 12 an inside outer cutter, which are combined concentrically or coaxially to form an outer cutter 14. The outside outer cutter 10 has a circular ring shape, the cross-section formed by the plane thereof in the radial direction inclusive of the centerline thereof, being shaped substantially as an inverted U that opens downward. The upper surface of the outside outer cutter 10 is formed of thin material, wherein many slit-shaped whisker induction holes 16 oriented substantially radially are formed in the circumferential direction. The outside outer cutter 10 is fitted from below into an outer cutter insertion hole 20 provided in an outer cutter case 18.

More specifically, the outer circumferential lower edge of the outside outer cutter 10 is bent outward at a plurality of locations in the circumferential direction, which bends 22 engage vertical channels 24 provided in the outer cutter case 18, from below. Here the vertical channels 24 open downward, the bends 22 engage into these vertical channels 24 from below; and, when they come up against the upper ends of the vertical channels 24, the upper limit position of the outside outer cutter 10 is established.

In the inner circumferential surface of the outside outer cutter 10, a plurality of slits 26 are formed which open downward. Into these slits 26, pawls 32 of the inside outer cutter 12 engage so as to be movable up and down, as is described below. In this condition, the inner circumferential lower edge of the outside outer cutter is secured by an anti-vibration ring 28 in the circumference direction. This anti-vibration ring 28 prevents vibration in an outside inner cutter guide 60 when protruding walls 76 provided in this outside inner cutter guide 60, described subsequently, slide against it.

The outer diameter of the inside outer cutter 12 is slightly smaller than the inner diameter of the outside outer cutter 10, whereupon insertion of the inside outer cutter 12 inside the inner diameter of the outside outer cutter 10 is possible. The center part of the inside outer cutter 12 is slightly sunken in, the outside thereof protrudes in a circular ring shape, and, there, many slit-shaped whisker induction holes 30 oriented substantially radially are formed in the circumferential direction.

The outer circumferential lower edge of the inside outer cutter 12 is bent outward at a plurality of locations in the circumferential direction, and pawls 32 comprising these bends are capable of engaging the slits 26 provided in the outside outer cutter 10. In the sunken part in the center of the inside outer cutter 12, a cap 34 is adhesively secured. The center of this cap 34 protrudes downward, passing through the inside outer cutter 12, and there a concavity 36 is formed. Into this concavity 36, a protrusion 86 on the center axis of rotation of the inside inner cutter guide 78, described subsequently, engages, whereupon shaft wobble in the inside inner cutter guide 78 is prevented.

Next, the inner cutter support unit is described. An inner cutter 50 has an outside inner cutter 52 that slides against the lower surface of the outside outer cutter 10, and an inside inner cutter 54 that slides against the lower surface of the inside outer cutter 12. The outside inner cutter 52 and the inside inner cutter 54 have outer circumferential portions of rings 56 and 58 consisting of thin metal sheet cut upward at a certain interval in the circumferential direction, so that the entirety is formed in what is substantially a windmill shape.

The outside inner cutter 52 is secured to the outside inner cutter guide 60. Here, the outside inner cutter guide 60 has a tubular part 62, a flange-shaped outside inner cutter holder 64 that extends in the outer radial direction from the upper part of this tubular part 62, and four openings 66 that pass through this outside inner cutter holder 64 in the up-and-down direction. In other words, the outside inner cutter holder 64, which is a ring-shaped disk, is held by four support arms 68 which extend out in a radial shape from the tubular part 62.

In the tubular part 62, an engagement hole 72 that is square as seen from above (FIG. 4) is formed, into which a drive shaft 70 (FIG. 2) that is rotationally driven by an electric motor engages from below. Into this engagement hole 72, an engagement ball 74 that is substantially square as seen from above, formed at the upper end of the drive shaft 70, engages, whereupon the outside inner cutter guide 60 is rotationally driven by the drive shaft 70. A circular ring part 56 of the above-described outside inner cutter 52 is bonded to the upper surface of the outside inner cutter holder 64.

On the upper surface of the outside inner cutter holder 64 of this outside inner cutter guide 60, four protruding walls 76 are formed so as to project upward from the vicinity of the outer circumferential ends of the support arms 68. The outer circumference of these protruding walls 76 slides against the inner circumferential surface of the anti-vibration ring 28 secured to the above-described outside outer cutter 10.

The inside inner cutter 54 is secured to the inside inner cutter guide 78. Here, the inside inner cutter guide 78 comprises an inside inner cutter holder 80, exhibiting what is substantially a crucifix form as seen from above, positioned above the above-described outside inner cutter guide 60, and four engagement pawls 82 that extend downward from the tip ends of what is substantially the crucifix form of this inside inner cutter holder 80. The engagement pawls 82 advance from above into the openings 66 of the outside inner cutter guide 60, and the lower ends of the engagement pawls 82 engage the inner circumferential edges of these openings 66 from below.

On the upper surface of the inside inner cutter holder 80, a protruding wall 84 that is hexagonal as seen from above, and the protrusion 86 that is positioned in the center thereof and protrudes upward, is formed. The circular ring part 58 of the inside inner cutter 54 is secured to the upper surface of this inside inner cutter holder 80. In the center of the circular ring part 58 a hexagonal opening is formed. This opening is made to fit around the outer circumference of the protruding wall 84 of the inside inner cutter holder 80, thereby securing together the inside inner cutter 54 and the inside inner cutter guide 78 in a definite manner.

Between the upper surface of the outside inner cutter guide 60, that is, the center of the upper surface of the outside inner cutter holder 64, and the lower surface of the inside inner cutter guide 78, a coil spring 88 is compressed and mounted. This coil spring 88, more specifically, is an upward-pushing spring that continually urges the inside inner cutter guide 78 upward, whereupon the inside inner cutter guide 78 moves up and down within the range of the play between the engagement pawls 82 and the inner circumferential edges of the openings 66 which they engage. Here, the return force of the coil spring 88 is set weaker than the return force on the drive shaft 70.

When the outside inner cutter guide 60 and the inside inner cutter guide 78 are combined in this manner, this assembly (inner cutter assembly) is mounted on the drive shaft 70. More specifically, the engagement ball 74 of the drive shaft 70 is engaged into the engagement hole 72 of the tubular part 62 of the outside inner cutter guide 60 below. Then the outer cutter case 18 wherein the outer cutter 14 has been mounted is mounted in the main case (not shown in the drawings). Here, the main case houses the motor, battery, and control circuit and the like, and the outer cutter case 18 is mounted on the top part thereof.

At this time, the outside inner cutter 52 engages with the lower surface of the outside outer cutter 10 and is pushed down, and pushes the drive shaft 70 down. That is, the outside inner cutter 52 contacts the outside outer cutter 10 due to the upward return force on the drive shaft 70. The inside inner cutter 54, moreover, engages with the lower surface of the inside outer cutter 12 and is pushed down. At this time, the inside inner cutter guide 78 to which the inside inner cutter 54 is secured compresses the coil spring (upward-pushing spring) 88. That is, the inside inner cutter 54 contacts the inside outer cutter 12 due to the return force of the spring 88.

When, in this condition, the motor is started, and the drive shaft 70 rotates, the inner- and outside inner cutters 60 and 78 rotate, and the outside inner cutter 52 and inside inner cutter 54 rotate while sliding against the lower surfaces of the outside outer cutter 10 and inside outer cutter 12. When only the inside outer cutter 12 comes against the skin surface and is pushed down, the inside inner cutter guide 78, together with the inside inner cutter 54, descends while compressing the coil spring 88. At this time, because the force of the coil spring 88 is set weaker than the return force on the drive shaft 70, the outside inner cutter guide 60 will not descend. For this reason, the outside inner cutter 52 will not descend so as to be removed from the lower surface of the outside outer cutter 10.

When only the outside outer cutter 10 comes against the skin surface and is pushed down, the outside inner cutter 52 and the outside inner cutter guide 60 descend while pushing down the drive shaft 70. At this time, the inside outer cutter 12 descends together with the outside outer cutter 10 because the outer circumferential pawls 32 in the inside outer cutter 12 are engaging the upper ends of the slits 26 in the outside outer cutter 10.

In this embodiment, as shown in FIGS. 2 and 4, the pawls 32 of the inside outer cutter 12 engage the upper edges of slits 26 in the outside outer cutter 10, in which condition the engagement pawls 82 of the inside inner cutter guide 78 will be removed from the inner circumferential edges of the openings 66 of the outside inner cutter guide 60. For this reason, when the outside outer cutter 10 is pushed down, the inside outer cutter 12 will stop with the pawls 32 thereof engaging the upper ends of the slits 26 of the outside outer cutter 10. As a consequence, when only the outside outer cutter 10 is pushed down, the inside outer cutter 12 also will descend integrally therewith.

Moreover, the outer cutters are not limited to combinations of two cutters, that is, of an outer circumferential one and an inner circumferential one, and it is possible instead to provide three or more outer cutters concentrically, and, corresponding thereto, array three or more inner cutters in a ring form. It should be apparent to one of ordinary skill that the present invention comprehends such configurations also.

The invention claimed is:

1. A rotary electric shaver comprising a plurality of outer cutters mutually deployed concentrically and a plurality of inner cutters that rotate while sliding said outer cutters from below, the rotary shaver comprising:

an outside outer cutter and an inside outer cutter provided coaxially and capable of moving up and down, independently of each other;

a drive shaft that is rotationally driven by an electric motor and to which an upward return tendency is imparted;

an outside inner cutter guide that engages said drive shaft and rotates integrally with said drive shaft;

an outside inner cutter that is secured to said outside inner cutter guide and slides against said outside outer cutter from below;

an inside inner cutter guide that engages said outside inner cutter guide from above so as to be able to move up and down and that rotates together with said outside inner cutter guide;

an inside inner cutter that is secured to said inside inner cutter guide and slides against said inside outer cutter from below; and an upward-pushing spring that is provided between an upper surface of, said outside inner cutter guide and a lower surface of said inside inner cutter guide thus urging said inside inner cutter guide upward; and wherein:

the outside outer cutter is such that the outer circumference thereof is held, so that it is moveable downwardly, in an outer cutter case;

the inside outer cutter is such that the outer circumference thereof is held, so that it can move downwardly, in the inner circumference of said outside outer cutter;

a plurality of slits are formed, so as to open downward, in the inner circumference of the outside outer cutter;

a plurality of pawls for engaging these slits are formed, protruding in the outer circumferential direction, in the outer circumference of the inside outer cutter; and the inner circumferential lower edge of said outside outer cutter, when said pawls engage into said slits, is secured in the circumferential direction by an anti-vibration ring.

2. The rotary electric shaver according to claim 1, wherein, in the outside inner cutter guide, a protruding wall that slides against the inner circumferential surface of the anti-vibration ring secured to the inner circumferential lower edge of the outside outer cutter for preventing shaft wobble in said outside inner cutter guide is erected so as to be oriented upward.

3. A rotary electric shaver comprising a plurality of outer cutters mutually deployed concentrically and a plurality of inner cutters that rotate while sliding against said outer cutters from below, the rotary shaver comprising:

an outside outer cutter and an inside outer cutter provided coaxially and capable of moving up and down, independently of each other;

a drive shaft that is rotationally driven by an electric motor and to which an upward return tendency is imparted;

an outside inner cutter guide that engages said drive shaft and rotates integrally with said drive shaft;

an outside inner cutter that is secured to said outside inner cutter guide and slides against said outside outer cutter from below;

an inside inner cutter guide that engages said outside inner cutter guide from above so as to be able to move up and down and that rotates together with said outside inner cutter guide;

an inside inner cutter that is secured to said inside inner cutter guide and slides against said inside outer cutter from below; and an upward-pushing spring that is provided between an upper surface of said outside inner cutter guide and a lower surface of said inside inner cutter guide, thus urging said inside inner cutter guide upward; and wherein:

said outside inner cutter guide comprises:

a tubular unit having an engagement hole into which the drive shaft engages;

an outside inner cutter holder unit that extends from the upper part of this tubular unit in the outer circumferential direction; and a plurality of openings that pass through this outside inner cutter holder unit in the up and down direction; and the inside inner cutter guide comprises:

an inside inner cutter holder unit positioned above said outside inner cutter guide; and a plurality of engagement pawls that extend downward from this inside inner cutter holder unit, advance into said outside inner cutter guide openings, and engage said outside inner cutter guide so as to be able to move up and down.

4. The rotary electric shaver according to claim 3, wherein the outside outer cutter is such that the outer circumference thereof is held, so that it is moveable downwardly, in an outer cutter case, and the inside outer cutter is such that the outer circumference thereof is held, so that it can move downwardly, in the inner circumference of said outside outer cutter.

* * * * *